US006725499B2

(12) United States Patent
Palobeis et al.

(10) Patent No.: US 6,725,499 B2
(45) Date of Patent: Apr. 27, 2004

(54) HOSE CLEANOUT FOR VACUUM CLEANER

(75) Inventors: Steven J. Palobeis, Painesville, OH (US); Paul D. Stephens, Twinsburg, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 217 days.

(21) Appl. No.: 10/044,469

(22) Filed: Jan. 11, 2002

(65) Prior Publication Data

US 2003/0131442 A1 Jul. 17, 2003

(51) Int. Cl.[7] ..... A47L 5/00; A47L 9/00; A47L 9/24

(52) U.S. Cl. ..... 15/339; 15/351; 15/412

(58) Field of Search ..... 15/339, 350, 351, 15/352, 353, 412; 55/DIG. 3

(56) References Cited

U.S. PATENT DOCUMENTS

| | | | | | |
|---|---|---|---|---|---|
| 2,353,621 | A | | 7/1944 | Replogle | |
| 2,849,080 | A | | 8/1958 | Enright | |
| 2,910,717 | A | | 11/1959 | Raymond | |
| 3,253,295 | A | | 5/1966 | Waters | |
| 3,267,650 | A | | 8/1966 | Lundin | |
| 3,277,512 | A | | 10/1966 | Waters | |
| 4,023,234 | A | | 5/1977 | Martinec et al. | |
| 4,364,146 | A | * | 12/1982 | Bowerman | 15/323 |
| 4,384,385 | A | | 5/1983 | Maurer | |
| 4,512,057 | A | * | 4/1985 | Laing et al. | 15/320 |
| 4,833,753 | A | | 5/1989 | Müller | |
| 5,247,720 | A | | 9/1993 | Sovis et al. | |
| 5,373,598 | A | | 12/1994 | Weber et al. | |
| 5,467,501 | A | | 11/1995 | Sepke | |
| 5,713,103 | A | * | 2/1998 | Keebler et al. | 15/323 |
| 6,101,670 | A | | 8/2000 | Song | |
| 6,141,826 | A | * | 11/2000 | Conrad et al. | 15/347 |
| 6,256,832 | B1 | | 7/2001 | Dyson | |
| 6,334,234 | B1 | * | 1/2002 | Conrad et al. | 15/347 |
| 2001/0054212 | A1 | * | 12/2001 | Walker | 15/350 |
| 2002/0129460 | A1 | * | 9/2002 | Roney et al. | 15/351 |

* cited by examiner

*Primary Examiner*—Terrence R. Till
(74) *Attorney, Agent, or Firm*—Fay, Sharpe, Fagan, Minnich & McKee, LLP

(57) ABSTRACT

A vacuum cleaner having a first housing member with at least one housing wall defining a first housing passage. The first housing passage having an intake end adjacent a subjacent surface and a discharge end opposite the intake end. A second housing member mounted on the first housing member with the second housing member including a filter chamber. The filter chamber has at least one filter chamber wall defining a collection cavity therein. The at least one filter chamber wall has a port communicating with the collection cavity. A vacuum source supported on either the first or second housing member and in fluid communication with the first housing passage and the port. A conduit extends between the discharge end of the first housing passage and the port of the filter chamber. The conduit has a conduit wall defining a conduit passage in fluid communication between the first housing passage and the port. An access port defined in the conduit wall, and a cover selectively mounted the access port to form a fluid-tight seal thereacross.

44 Claims, 11 Drawing Sheets

344
310
360
362
350
374
372
370
404
354
406
386
436
388
438
360
430
14
14
390
432
382
354
320
322
342
342
342

HOSE CLEANOUT FOR VACUUM CLEANER

BACKGROUND OF THE INVENTION

The present invention relates to vacuum cleaning devices and, more particularly, to upright vacuum cleaners having access ports with fluid-tight covers for use in clearing out clogged vacuum passages extending through the vacuum cleaner. While the invention will be described as employed in upright vacuum cleaners, it should be appreciated that the invention could also be employed in other types of vacuum cleaners.

Upright vacuum cleaners have been provided heretofore, and generally are known to include a surface or floor engaging housing that has a passageway extending therethrough. The passageway has an intake opening adjacent the surface, and a discharge opening at the opposite end of the passageway. A vacuum or suction generator communicates with the passageway to induce airflow into the intake opening and out of the discharge opening. As the air is moved into the passageway through the intake opening, debris and other foreign particles are carried from the surface into the passageway along with the in-flowing air. The debris and other foreign particles are spirited along the passageway and exit the housing through the discharge opening.

Traditional upright vacuum cleaners commonly include a nozzle base and an upper housing. The upper housing is typically hingedly mounted on the nozzle base, and normally has a grip portion and a body portion. The body portion includes a suitable filter chamber including a receptacle for collecting the debris and foreign particles. Extending between the discharge opening in the housing and the receptacle is a further passageway or conduit that carries the airflow and debris from the housing to the collection receptacle. Anyone of a variety of methods or devices may be used to separate the debris and foreign particles from the airflow at or near the receptacle so that only clean air is exhausted by the vacuum cleaner.

As upright vacuum cleaning devices have developed, more and more powerful vacuum generation devices are being used to create the suction airflow at the intake opening of the housing, and thereby become increasingly effective at cleaning dirt, debris and other foreign particles from floor surfaces. However, the passageways extending through the nozzle base and along the upper housing have also become increasingly lengthy and can become blocked as debris which is picked up becomes lodged within the passageway, causing a disruption of airflow and a significant decrease in performance.

In addition to the foregoing performance gains, upright vacuum cleaners commonly include a variety of attachments for removing debris and foreign particles from surfaces other than floors. Such attachments typically include a length of flexible hose, and numerous brushes and nozzles of various shapes, sizes and configurations. The length of flexible hose often interconnects with the conduit within the body that carries the airflow produced in the housing by the vacuum generator to the collection receptacle. As the airflow moves through the conduit, it passes the interconnection of the length of hose from the attachment. This creates a suction airflow through the attachment hose and nozzle suitable for removing foreign particles and other debris from these other surfaces.

At the interconnection of the conduit and the attachment hose, the debris flowing through the attachment hose must change directions, often making a 90 degree turn, to continue into and along the conduit toward the receptacle. In this area, the passageway can become blocked, again causing disruption of airflow and a significant decrease in performance.

Accordingly, it is desirable to provide a vacuum cleaning device having an access port and fluid-tight cover for such a port which would overcome the foregoing deficiencies and others while meeting the above-stated needs and providing better and more advantageous overall results.

SUMMARY OF THE INVENTION

In accordance with one aspect of the invention, a vacuum cleaner is provided comprising a first housing member having at least one housing wall defining a first housing passage. The first housing passage has an intake end adjacent a subjacent surface and a discharge end opposite the intake end. The vacuum cleaner also includes a second housing member mounted on the first housing member. The second housing member includes a filter chamber having at least one filter chamber wall defining a collection cavity. The wall includes a port communicating with the collection cavity. The vacuum cleaner is further comprised of a vacuum source supported on either the first or second housing member and is in fluid communication with the first housing passage and the port in the filter chamber wall. The vacuum cleaner also includes a conduit, an access port and a cover for the access port. The conduit extends between the discharge end of the first housing passage and the port in the filter chamber wall. The conduit includes a conduit wall defining a conduit passage that is in fluid communication between the first housing passage and the port. The access port is defined in the conduit wall and the cover is selectively mounted over the access port to form a fluid-tight seal thereacross.

According to another aspect of the present invention, a vacuum cleaner is provided that is comprised of a nozzle base and an upper housing mounted on the nozzle base. The nozzle base has at least one base wall defining a base passage. The base passage has an intake end adjacent a subjacent surface, and a discharge end opposite the intake end. The upper housing has a body portion that includes a filter chamber. The filter chamber has a receptacle wall with a port in communication with the filter chamber. The vacuum cleaner is further comprised of a vacuum source supported on either the nozzle base or the upper housing. The vacuum source is in fluid communication with the base passage and the filter chamber, and generates suction airflow at the intake end of the base passage. The vacuum cleaner also includes a first conduit extending between the discharge end of the base passage and the port in the receptacle wall of the filter chamber. The first conduit includes a first conduit wall. An access port extends through the first conduit wall. The vacuum cleaner further includes a cover having a cover wall cooperable with the access port for forming a fluid-tight seal thereacross. The cover also has an extension having an aperture for accommodating a fastener to secure the cover to the upper housing.

According to a further aspect of the present invention, a vacuum cleaner is provided that is comprised of a nozzle base and an upper housing mounted on the nozzle base. The nozzle base has at least one base wall defining a base passage. The base passage has an intake end adjacent a subjacent surface, and a discharge end opposite the intake end. The upper housing has a body portion that includes a filter chamber. The filter chamber has at least one receptacle wall, and the receptacle wall includes a port in fluid communication with the filter chamber. The vacuum cleaner also includes a vacuum source supported on either the nozzle base or the upper housing. The vacuum source is in fluid communication with the base passage and generates suction airflow at the intake end thereof. The vacuum cleaner has a conduit that extends between the discharge end of the base passage and the port of the filter chamber. The conduit has a conduit wall with an access port extending therethrough. The vacuum cleaner is further comprised of a transparent cover that has a cover wall cooperable with the access port forming a fluid-tight seal therewith. The transparent cover allows an operator to see any blockages in the conduit.

BRIEF DESCRIPTION OF THE DRAWINGS

The invention may take form in certain components and structures, preferred embodiments of which will be illustrated in the accompanying drawings in which.

DESCRIPTION OF PREFERRED EMBODIMENTS

Figure 1:
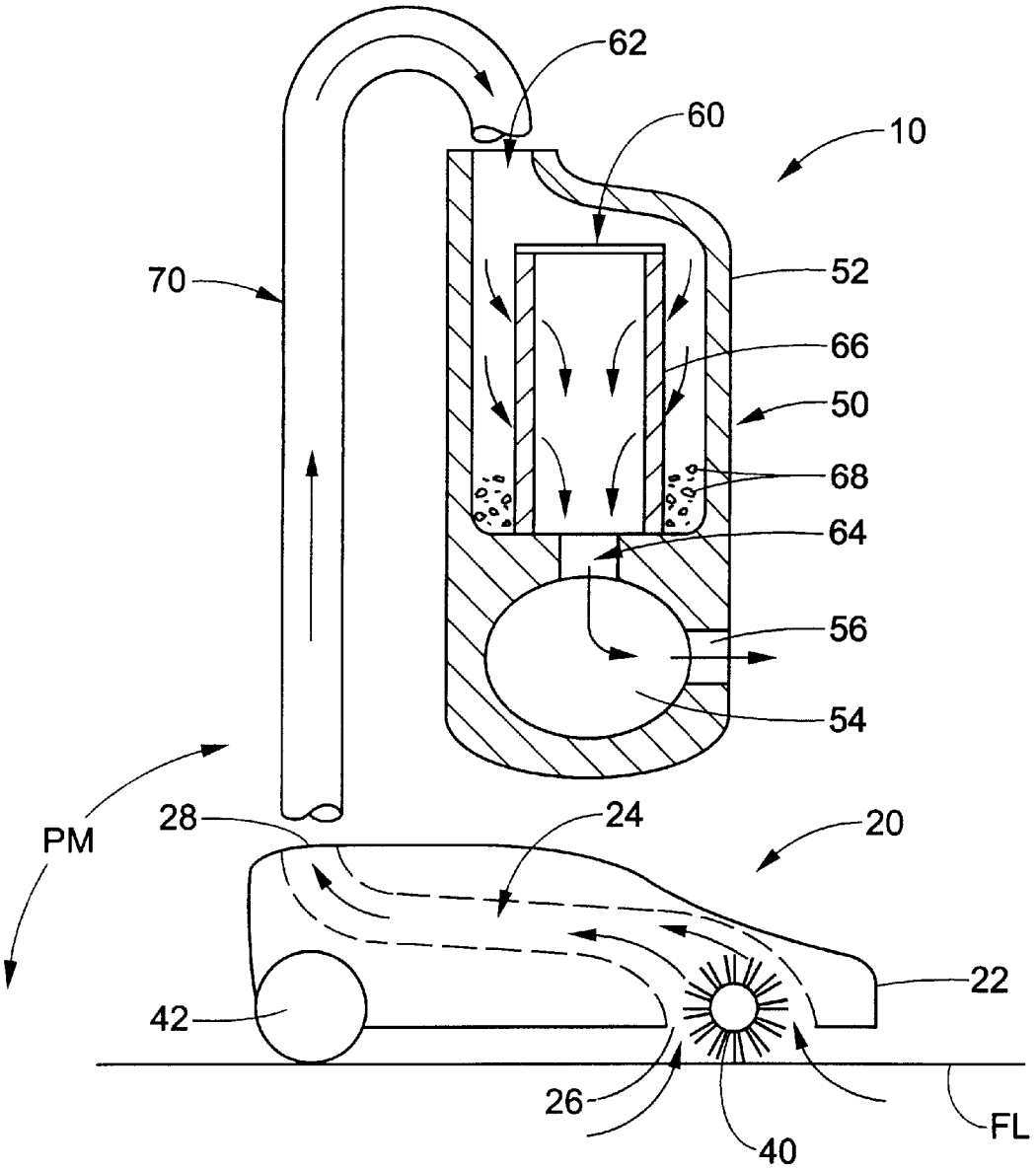
FIG. 1 (PRIOR ART)
FIG. 1 is a schematic side elevational view of a prior art upright vacuum cleaner housing.

It will be appreciated that FIG. 1 schematically illustrates the components and airflow path of a conventional upright vacuum cleaner. Such vacuum cleaners are generally known by those skilled in the art, and the following discussion of FIG. 1 is merely provided to establish background environment and terminology for further discussion of the preferred embodiments of the present invention.

FIG. 1 illustrates an upright vacuum cleaner 10 having a nozzle base 20 and an upper housing 50. The nozzle base generally engages a subjacent surface, such as a floor FL. Nozzle base 20 includes a base housing 22 having a base housing passage 24 extending therethrough. The base housing passage has an intake opening 26 at one end and a discharge opening 30 at the opposite end of passage 24. Intake opening 26 is positioned on base housing 22 adjacent floor FL for the intake of foreign particles from the floor. The base housing passage also includes a discharge opening 28 that extends through base housing 22 opposite intake opening 26. A brush roller 40 is rotatably mounted adjacent or within the intake opening for dislodging foreign particles from floor FL. However, it will be appreciated that other dislodging devices are commonly employed to dislodge the foreign particles. Vacuum cleaner 10 can further include several floor engaging wheels 42 that facilitate the movement of the vacuum cleaner across the floor. Commonly, upper housing 50 is hingedly supported on nozzle base 20, as indicated by arrow PM, further providing for movement of vacuum cleaner 10 across floor FL.

Upper housing 50 includes a vacuum or suction airflow generator, such as motor and fan arrangement 54. The upper housing further includes a upper housing wall 52 defining a filter chamber 60. The filter chamber includes a chamber intake opening 62 and a chamber discharge opening 64 for the flow of air to pass into and out of filter chamber 60. A filter 66 is secured between openings 62 and 64 for removing contaminants 68 from the incoming airflow. The upper housing includes an exhaust 56 extending through upper wall 52 downstream from motor and fan arrangement 54. A conduit 70 extends between discharge opening 32 on the nozzle base and chamber intake opening 62 so that a generally continuous passageway is formed between intake opening 26 of housing passage 24 and exhaust port 56 of upper housing 50.

In operation, motor and fan arrangement 54 generates a suction airflow into intake opening 26, through base housing passage 24 and out discharge opening 28 to conduit 70. The suction airflow flows through the conduit and into filter chamber 60 of upper housing 50. The suction airflow passes into the filter chamber, through filter 66 thereby separating foreign particles 68 from the air. The filtered air, still being drawn toward the motor and fan arrangement, flows out of the filter chamber through chamber discharge opening 64 past the motor and fan arrangement and out of exhaust port 56 to ambient atmosphere.

It will be appreciated to those skilled in the art that the motor portion of motor and fan arrangement 54 is commonly an electric motor, and that the vacuum cleaner will have a power supply cord for supplying electrical power to the motor. It will be further appreciated that the vacuum cleaner may also have one or more switches or other suitable electronic components for controlling the motor and other features of the device. Additionally, it will be appreciated by those skilled in the art that vacuum cleaners may include other arrangements for filtering foreign particles from the airflow stream, such as commonly known filter bag arrangements.

Figure 2:
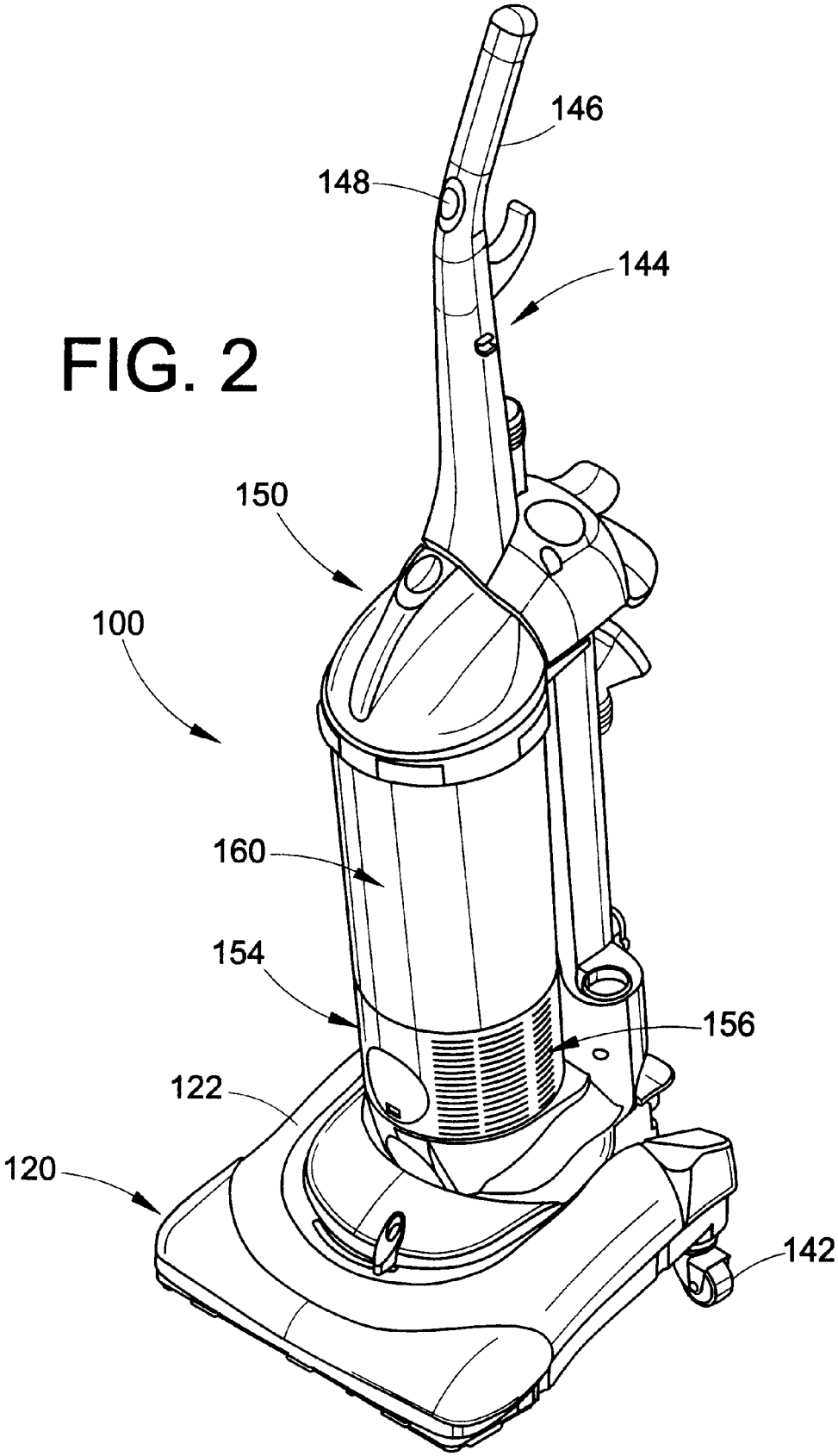
FIG. 2 is a perspective view of one embodiment of an upright vacuum cleaner having an access port in accordance with the present invention.

Referring now in greater detail to the drawings, wherein the showings are for the purpose of illustrating preferred embodiments of the invention only, and not for the purpose of limiting the invention, a first embodiment in accordance with the present invention is illustrated in FIGS. 2–8. Shown in FIG. 2 is an upright vacuum cleaner 100 having a nozzle base 120 and an upper housing 150 hingedly supported on the nozzle base. The nozzle base includes a base housing 122 and plural casters 142 for engaging a subjacent surface. The upper housing includes a motor and fan arrangement 154 and a filter chamber 160. Clean air is exhausted by the motor and fan arrangement through exhaust slots 156. Extending from the upper housing is a handle member 144 having a grip portion 146. Supported on handle member 144 adjacent grip portion 146 is control switch 148 for activating and deactivating the motor and other electrical components.

Figure 3:
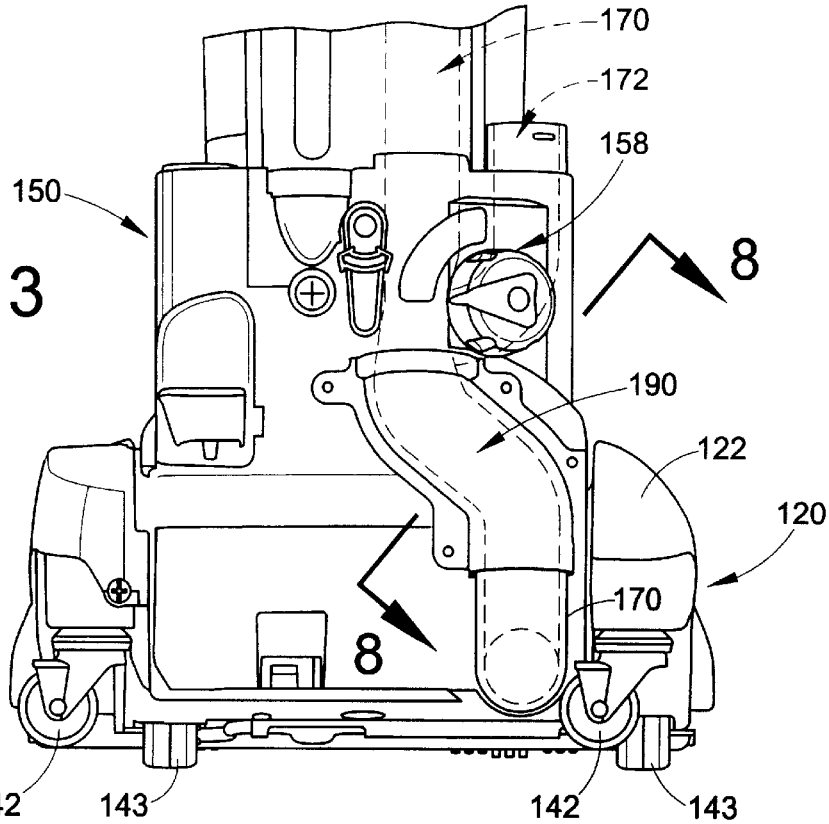
FIG. 3 is a partial rear elevational view of the vacuum cleaner of FIG. 2.
Figure 4:
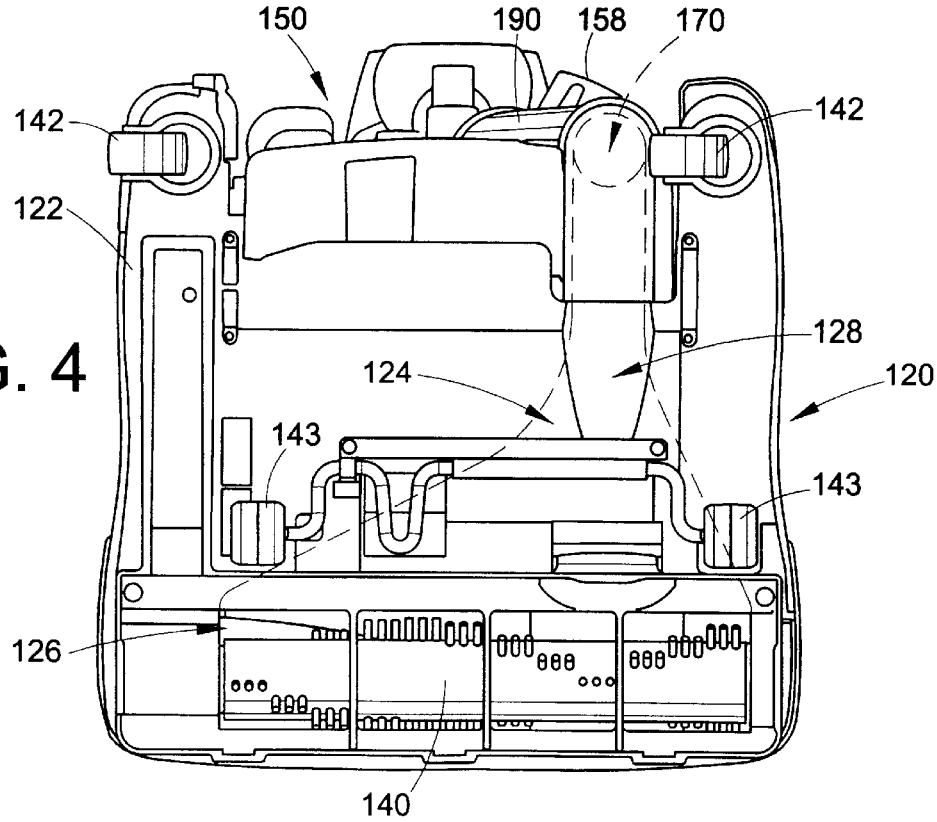
FIG. 4 is a bottom plan view of the vacuum cleaner of FIG. 2.

As shown in FIGS. 3 and 4, nozzle base 120 includes a base housing 122 having a base housing passage 124 extending therethrough. The base housing passage extends between an intake opening 126 and a discharge opening 128 each being located at opposing ends of passage 124. Rotatably supported adjacent intake opening 126 is brush roller 140. Rollers 143 can also be located on base housing 122. The rollers 143 can be part of a height adjust mechanism for the vacuum cleaner.

Figure 5:
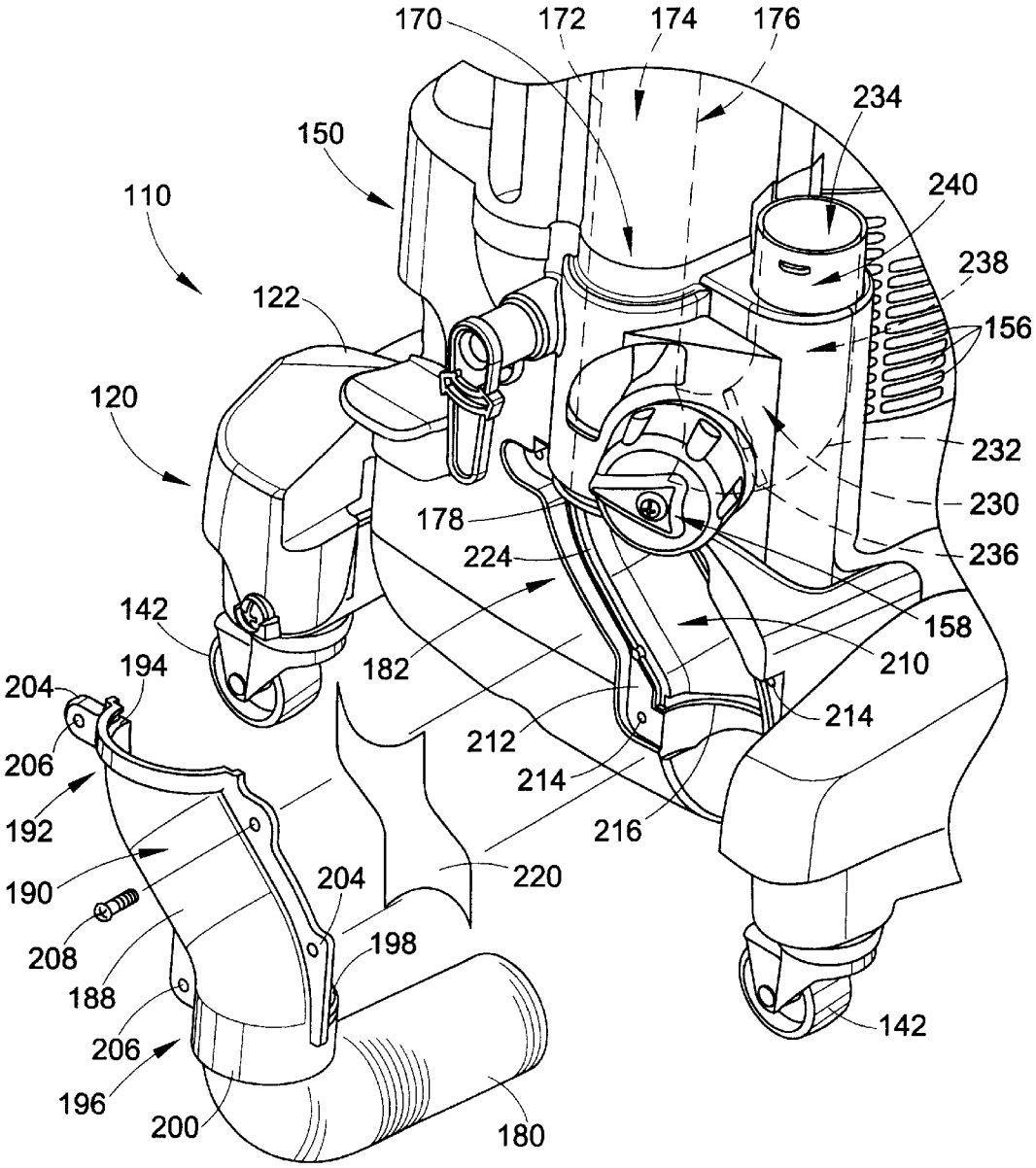
FIG. 5 is an exploded perspective view of a portion of the vacuum cleaner of FIG. 2 illustrating an access port, a cover and a portion of conduit in accordance with the present invention.
Figure 6:
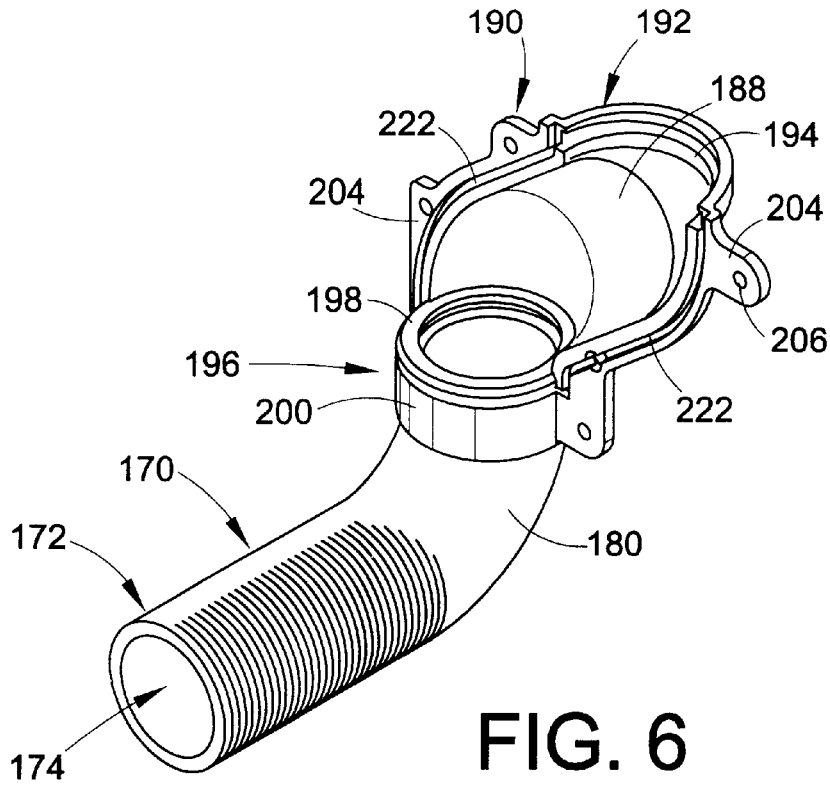
FIG. 6 is a perspective view of the cover and conduit of FIG. 5.
Figure 7:
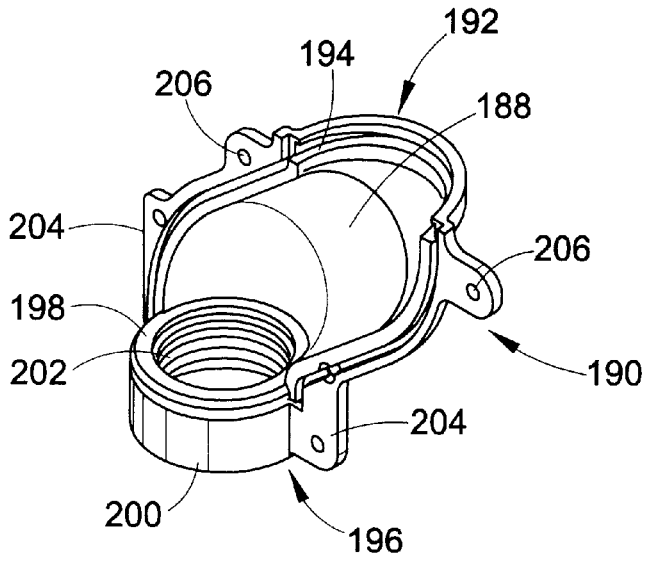
FIG. 7 is a perspective view of the cover of FIG. 6.
Figure 8:
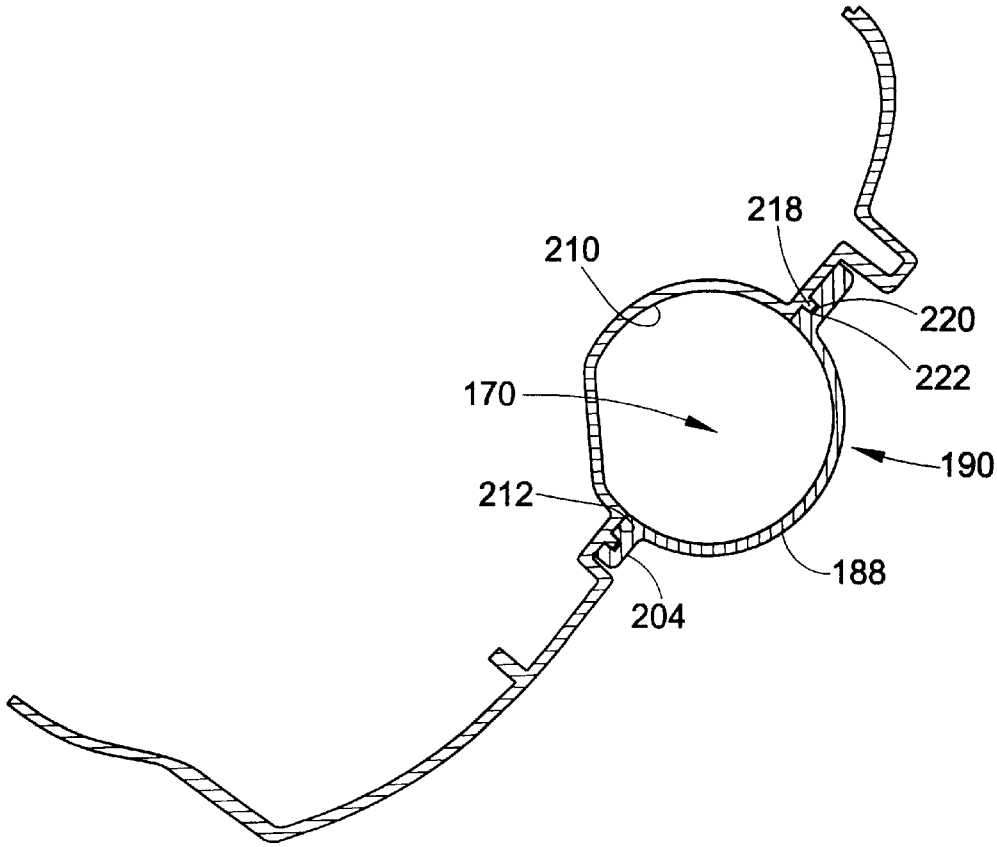
FIG. 8 is a partial cross-sectional view of the cover and conduit taken along line 8—8 in FIG. 3.

As is further illustrated in FIG. 5, upper housing 150 includes a conduit 170 extending between discharge opening 128 of passage 124 and filter chamber 160. Conduit 170 includes a conduit wall 172 that defines a first conduit passage 174. The conduit wall has both a rigid portion 176 and a flexible portion 180. The conduit includes a channel 210 formed in the upper housing. Rigid portion 176 of the conduit wall includes a rigid end wall 178, and channel 210 extends from conduit wall 172 adjacent the rigid end wall. An access port 182 is formed from wall 178, channel 210 and a channel end wall 216. A cover 190 is supported on upper housing 150 along conduit 170 at access port 182. The cover includes a cover wall 188, a first end 192 and a second end 196. The first end has a first end wall 194, and the second end has a second end wall 198 each extending from cover wall 188. Cover wall 188 is complementary with conduit wall 172 and channel 210, and the cover generally forms a fluid-tight seal across the access port. A gasket 220 is compressively positioned between cover 190 and upper housing 150 adjacent channel 210, rigid end wall 178 and channel end wall 216. As shown in FIGS. 5–8, the cover and upper housing cooperatively include a gasket retainer, such as gasket groove 222 in the cover and gasket boss 224 on the upper housing. It will be appreciated, however, that other sealing arrangements are commonly known by those skilled in the art.

Cover 190 includes a cylindrical wall 200 extending from second end 196 that is adapted to engage flexible portion 180 of conduit wall 172. In this embodiment, the flexible portion is received within the cylindrical wall forming a fluid-tight seal therewith. Cylindrical wall 200 includes internal threads 202 complementary with suitable threading defined on the flexible portion of the conduit wall. It will be appreciated, however, that other suitable connections may be employed without departing from the principles of the present invention. Extending from cover wall 188 are mounting flanges 204. The mounting flanges are suitable for supporting the cover on upper housing 150 adjacent channel 210 as discussed above. Flanges 204 include apertures 206 for receiving the shaft of a fastener 208. Upper housing 150 has a cover mounting surface 212 adjacent channel 210 for receiving cover 190, and further includes fastener receiving holes 214 cooperable with fasteners 208 for securing the cover to the upper housing. It will be appreciated that it is desirable for cover 190 to be formed from a transparent material so that obstructions in the conduit may be observed by the operator and later removed through the access port.

The upper housing also includes a second conduit 230 extending from conduit 170 and a valve arrangement 158 positioned along conduit 230. The second conduit has a second conduit wall 232 defining a second conduit passage 234 extending therethrough. The second conduit also has a proximal end 236 adjacent conduit 170 and a distal end 238 opposite the proximal end. A connector 240 is supported on upper housing 150 adjacent the distal end of second conduit 230. The second conduit passage is in fluid communication with the first conduit passage 174. Valve arrangement 158 is displaceable between two end positions (not shown). In one end position, the valve arrangement substantially prevents suction airflow along passage 234 of conduit 230 while permitting flow along passage 174 of conduit 170. In the second position, the valve arrangement substantially inhibits suction airflow along passage 174 of conduit 170 and permits flow along passage 234 of conduit 230.

FIGS. 9–14 illustrate an alternate embodiment of the upright vacuum cleaner shown in FIGS. 2–8. Unless otherwise indicated, the items in FIGS. 9–14 correspond to those illustrated and discussed with respect to FIGS. 2–8. However, the items in FIGS. 9–14 include reference numerals incremented by 200. For example, the vacuum cleaner 110 in FIG. 2 corresponds to item 310 in FIG. 9. Items shown and described in one drawing figure, but having no counterpart in one or more of the other figures, will be distinctly pointed out and discussed as necessary.

Figure 9:
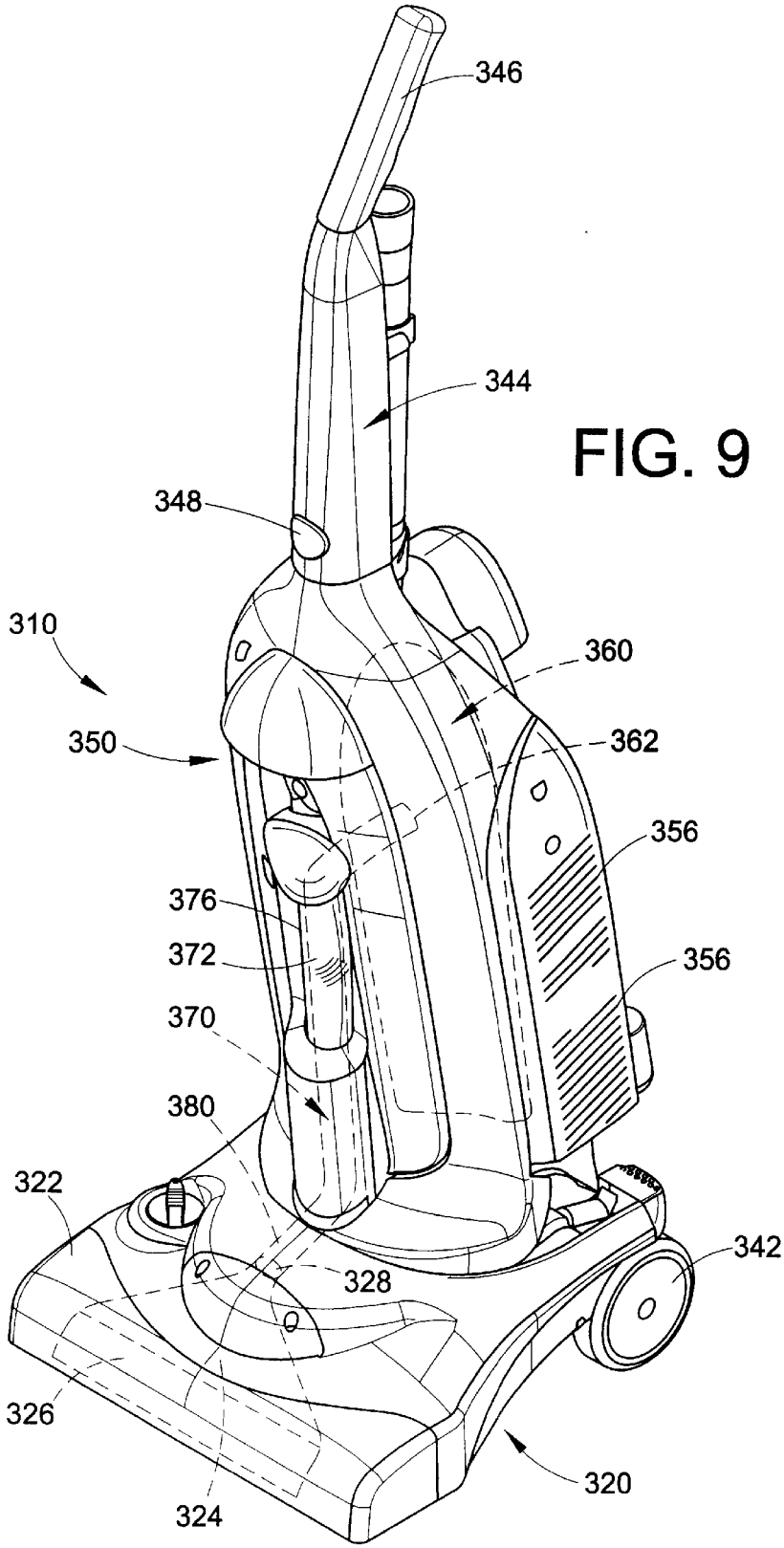
FIG. 9 is a perspective view of a second embodiment of an upright vacuum cleaner having an access port in accordance with the present invention.

FIG. 9 illustrates a vacuum cleaner 310 having a nozzle base 320 and an upper housing 350 hingedly supported on the nozzle base. The nozzle base includes a base housing 322 having a base housing passage 324 extending therethrough. The base housing passage has an intake opening 326 and a discharge opening 328 at opposing ends of the base housing passage. The upper housing includes a motor and fan arrangement 354 leading to exhaust ports 356 and a filter chamber 360. Extending from the upper housing is a handle member 344 having a grip portion 346 and a control switch 348. A conduit 370 extends between discharge opening 328 and filter chamber 360. The conduit has a conduit wall 372 defining a first conduit passage 374. The conduit wall can include a rigid portion 376 and a flexible portion 380.

Figure 10:
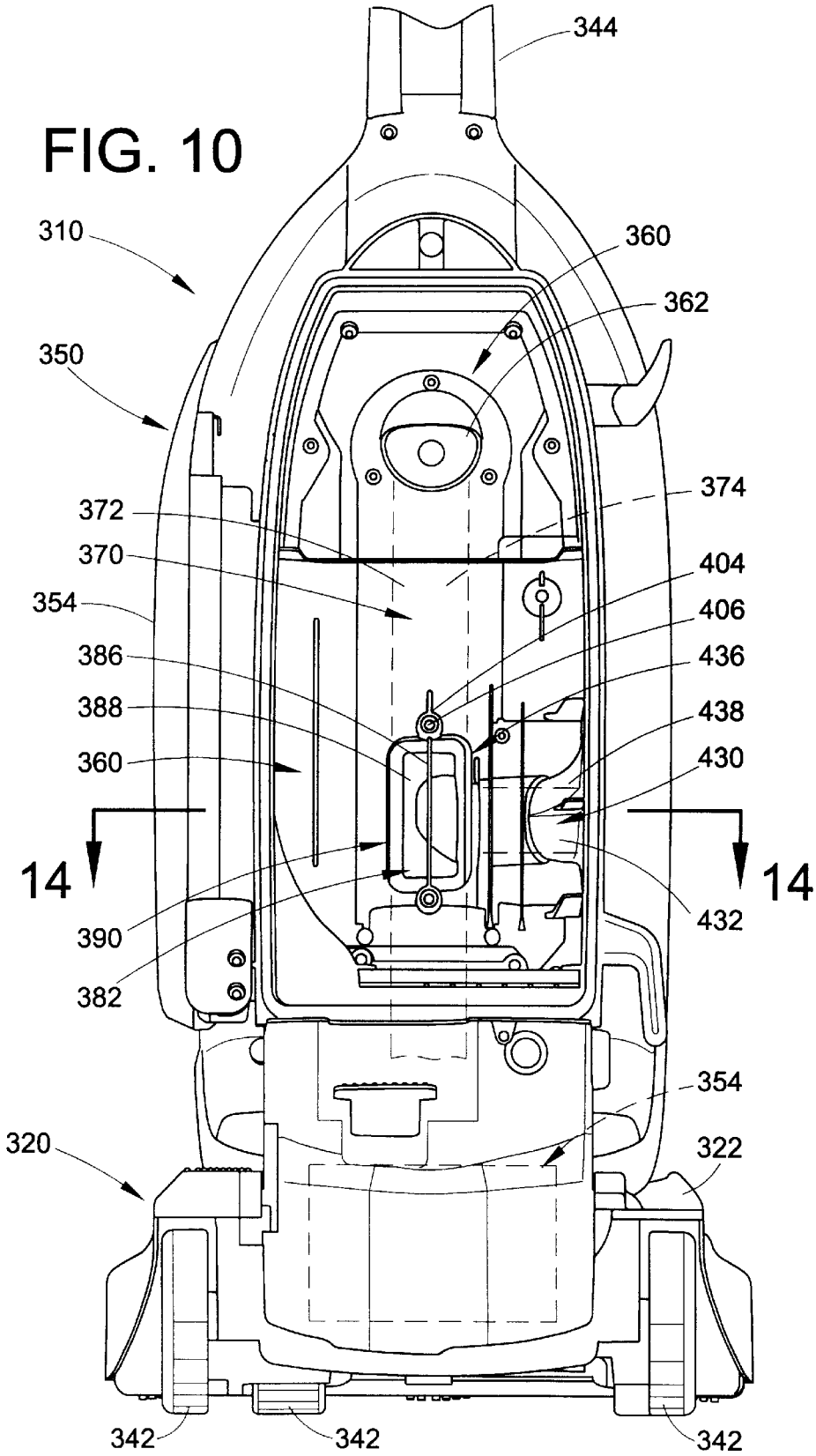
FIG. 10 is a partial rear elevational view of the upright vacuum cleaner of FIG. 9, with a rear door partially broken away.
Figure 11:
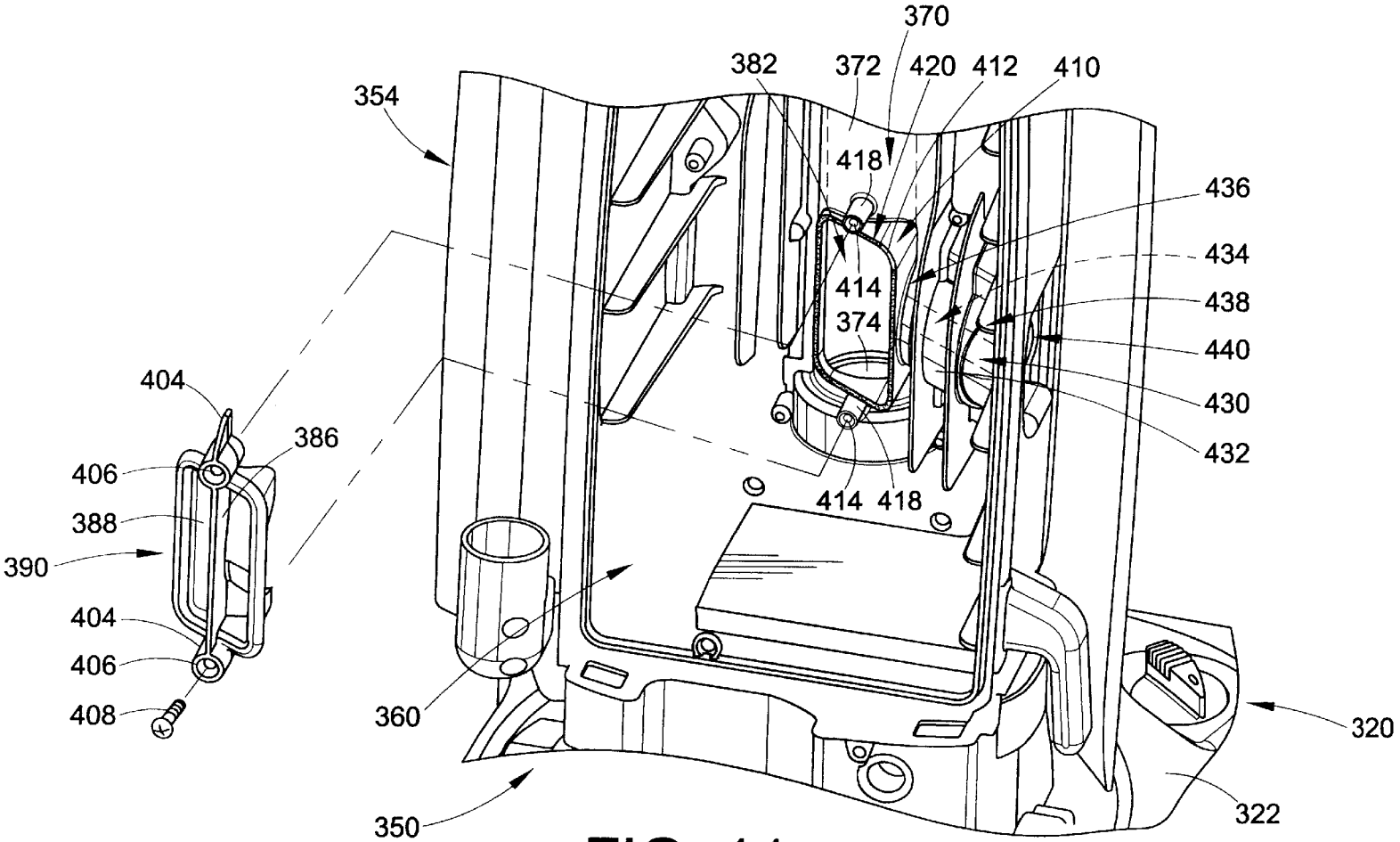
FIG. 11 is an exploded perspective view of a portion of the vacuum cleaner of FIG. 10 illustrating an access port and a cover in accordance with the present invention.
Figure 12:
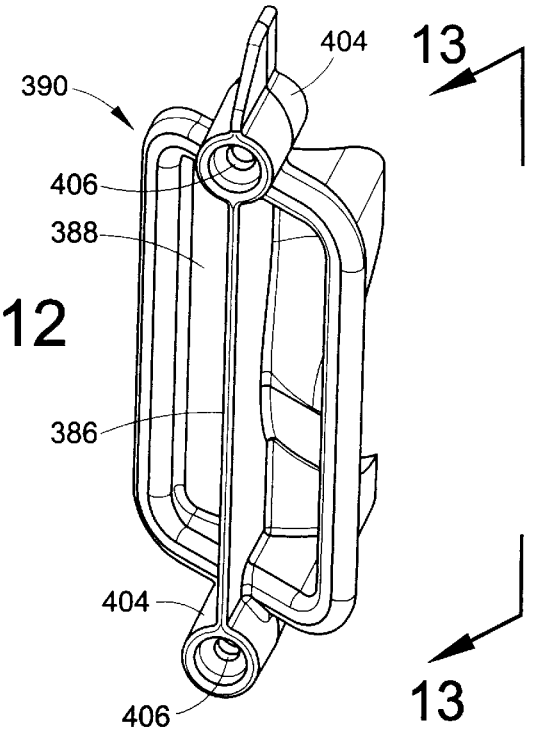
FIG. 12 is a perspective view of the cover in FIG. 11.
Figure 13:
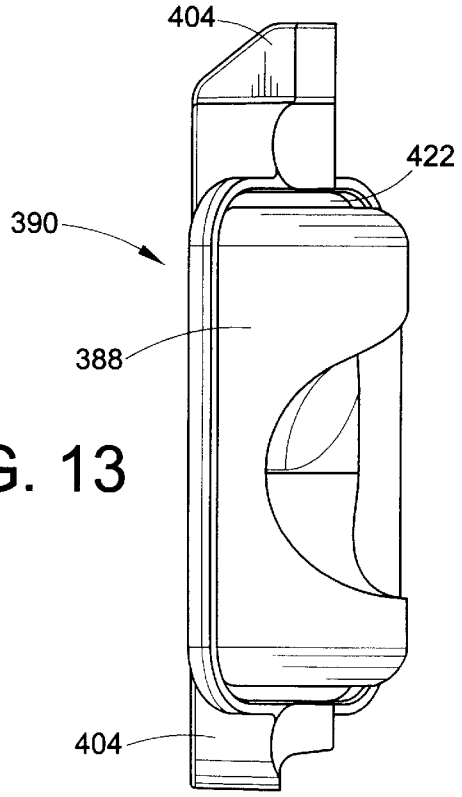
FIG. 13 is a right side elevational view of the cover of FIG. 12.
Figure 14:
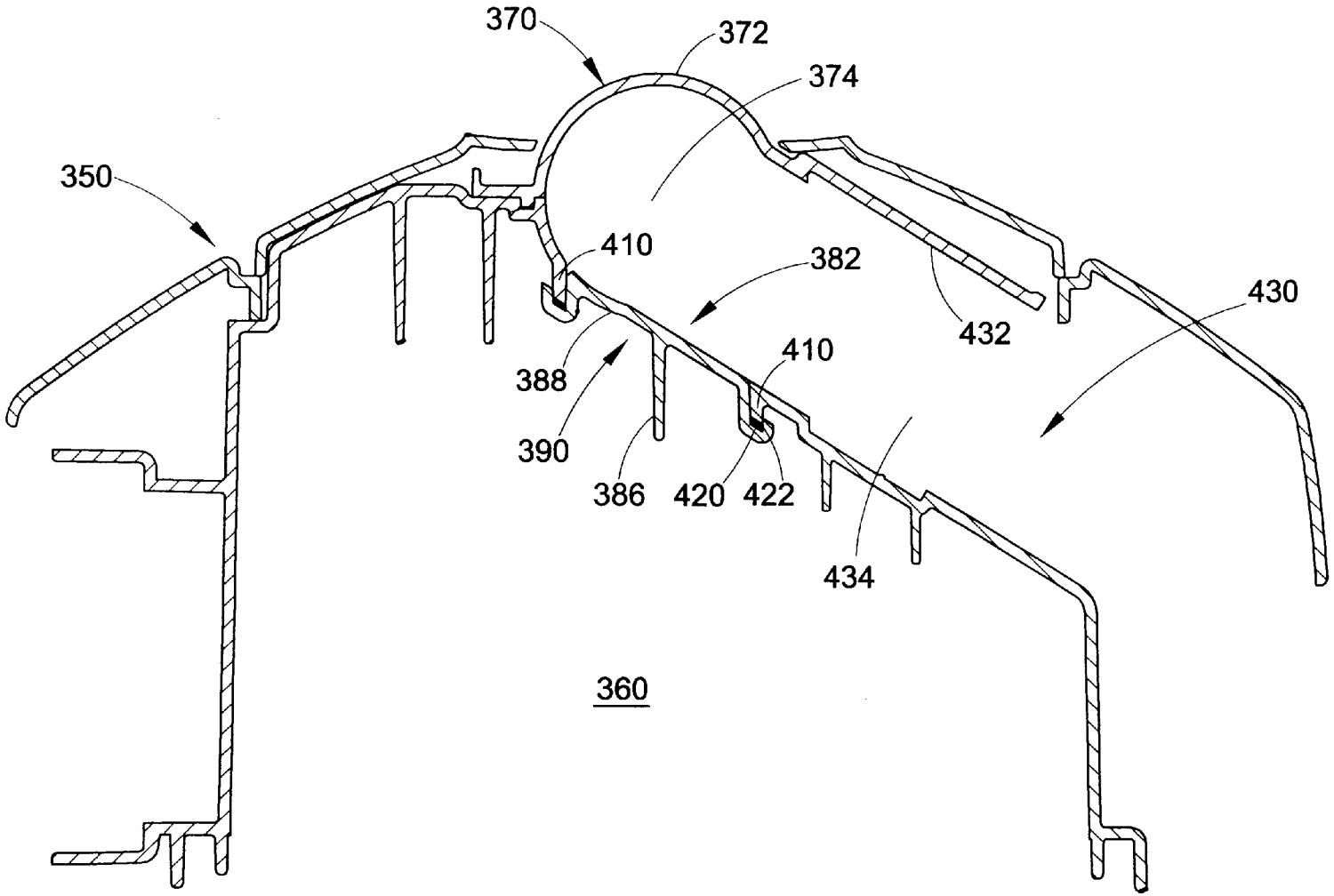
FIG. 14 is a partial cross-sectional view of the cover and conduit taken along line 14—14 in FIG. 10.

As illustrated in FIGS. 10 and 11, filter chamber 360 is positioned along the back of upper housing 350. Conduit 370 extends along the front of the upper housing and passes therethrough into the filter chamber forming a chamber intake opening 362. It will be appreciated that the suction airflow generated by the motor and fan arrangement is drawn in through the intake opening of the base housing passage and along the conduit in the conventional manner. The suction airflow is drawn into the filter chamber from the conduit through the chamber intake opening and into a filter bag (not shown). The filter bag retains the foreign particles carried along with the suction airflow and discharges filtered air through the walls (not shown) of the bag (not shown). The motor and fan arrangement draws the filtered air through the walls of the filter bag and discharges clean air through the exhaust ports on the exterior of the upper housing. It will be appreciated that additional filtration may be provided downstream of the filter bag and prior to discharge through the exhaust ports.

Upper housing 350 further includes a second conduit 430 extending from conduit 370. Second conduit 430 has a second conduit wall 432 defining a second conduit passage 434. The second conduit passage is in fluid communication with the first conduit passage 374. The second conduit has a proximal end 436 adjacent conduit 370 and a distal end 438 opposite the proximal end. A coupling 440 is formed in upper housing 350 adjacent distal end 438.

An access port 382 extends through conduit wall 372 placing passages 374 and 434 in fluid communication with ambient atmosphere. A cover 390 includes a cover wall 388 and is cooperable with the access port to form a fluid-tight seal thereacross. Extending from conduit wall 372 is a port peripheral wall 410 generally defining the periphery of access port 382. Cover 390 is supported on port peripheral wall 410 such as by fasteners 408. Cover 390 includes an extension 404 having an aperture 406 extending therethrough for receiving the shaft of fastener 408. Bosses 418 extend from conduit 370 and include fastener receiving holes 414 for securedly receiving fasteners 408. It will be appreciated that cover 390 may be formed from a transparent material as discussed hereinbefore.

A gasket 420 is positioned between port peripheral wall 410 and cover 390. The gasket is cooperably secured along cover 390 in a gasket groove 422 extending peripherally around the cover cooperably with port peripheral wall 410.

The present invention thus pertains to a vacuum cleaner having an access port extending along the airflow conduit thereof for the removal of debris lodged therein. A cover cooperates with the access port to minimize the noise and performance loss from air leaking through the access port. The cover can be remotely located from rotating or otherwise moving parts. The access port and cover are so located as to promote the ease and convenience of use of the access port thereby promoting and maintaining the performance level of the vacuum cleaner. The cover can include a minimum number of parts and is structurally simple, thereby promoting the economical production of it.

While the invention has been described with reference to the preferred embodiments, and considerable emphasis has been placed herein on the structures and structural interrelationships between the component parts of the embodiments disclosed, it will be appreciated that other embodiments of the invention can be made, and that many changes can be made in the embodiments illustrated and described without departing from the principles of the invention. Obviously, modifications and alterations will occur to others upon reading and understanding the preceding detailed description. Accordingly, it is to be distinctly understood that the foregoing descriptive matter is to be interpreted merely as illustrative of the present invention and not as a limitation. As such, it is intended that the invention be construed as including all such modifications and alterations insofar as they come within the scope of the appended claims or the equivalents thereof.

What is claimed is:

1. A vacuum cleaner comprising:

a first housing member having at least one housing wall defining a first housing passage, said first housing passage having an intake end adjacent a subjacent surface and a discharge end opposite said intake end;

a second housing member mounted on said first housing member, said second housing member including a filter chamber, said filter chamber comprising at least one filter chamber wall defining a collection cavity therein, wherein said at least one filter chamber wall includes a port communicating with said collection cavity;

a vacuum source supported on one of said first housing member and said second housing member and in fluid communication with said first housing passage and said port;

a conduit extending between said discharge end of said first housing passage and said port of said filter chamber, said conduit having a conduit wall defining a conduit passage in fluid communication between said first housing passage and said port;

an access port defined in said conduit wall; and, a cover selectively mounted over said access port to form a fluid-tight seal thereacross.

2. The vacuum cleaner according to claim 1, wherein said second housing member is hingedly mounted on said first housing member.

3. The vacuum cleaner according to claim 2, wherein said conduit wall comprises a flexible wall portion and a rigid wall portion extending along a part of said second housing member.

4. The vacuum cleaner according to claim 3, wherein said flexible wall portion of said conduit wall extends between said discharge end of said housing passage and said rigid wall portion of said conduit.

5. The vacuum cleaner according to claim 3, wherein said cover includes a first end having a first end wall and a second end having a second end wall, said second end being adapted to interengage said flexible wall portion of said conduit wall.

6. The vacuum cleaner according to claim 3, wherein said rigid wall portion of said conduit includes a rigid end wall, and said second housing member includes a channel longitudinally extending from said conduit adjacent said rigid end wall and a channel end wall adjacent said channel, wherein said access port of said conduit is defined in said rigid end wall of said conduit and said channel and said channel end wall of said second housing member.

7. The vacuum cleaner according to claim 6, wherein said cover includes a first end with a first end wall and a second end with a second end wall, said second end being adapted to interengage said flexible wall portion of said conduit wall.

8. The vacuum cleaner according to claim 3 further including a gasket interposed between said cover and said second housing member.

9. The vacuum cleaner according to claim 8, wherein said cover includes a gasket groove extending peripherally along at least a portion thereof, and said gasket is at least partially received in said gasket groove.

10. The vacuum cleaner according to claim 1, wherein said conduit wall includes a first rigid wall portion defining a first conduit passage, wherein said second housing member further includes a second rigid wall portion defining a second conduit passage extending from said first conduit passage and forming a junction therewith, and said second conduit passage being in fluid communication with said first conduit passage at said junction.

11. The vacuum cleaner according to claim 10, wherein said access port extends through said first rigid wall portion adjacent said junction between said first and second conduit passages.

12. The vacuum cleaner according to claim 11, wherein said first rigid wall portion of said conduit includes a port peripheral wall extending from at least one of said first and second rigid wall portions of said second housing member.

13. The vacuum cleaner according to claim 12, wherein a gasket is positioned between said cover wall and said port peripheral wall.

14. The vacuum cleaner according to claim 10, wherein said second housing member includes a valve disposed along at least one of said first conduit passage and said second conduit passage, said valve being moveable between a first and a second end position.

15. The vacuum cleaner according to claim 14, wherein in said first end position, said valve permits a flow of air through said first conduit and substantially prevents a flow of air through said second conduit.

16. The vacuum cleaner of claim 15 wherein in said second end position, said valve permits a flow of air through said second conduit and substantially prevents a flow of air through said first conduit.

17. A vacuum cleaner comprising:

a nozzle base having at least one base wall defining a base passage, said base passage having an intake end adjacent a subjacent surface and a discharge end opposite said intake end;

an upper housing mounted on said nozzle base, said upper housing having a body portion including a filter chamber, said filter chamber comprising at least one receptacle wall having a port in communication with said filter chamber;

a vacuum source supported on one of said nozzle base and said upper housing and being in fluid communication with said base passage and said filter chamber, said vacuum source generating suction airflow at said intake end of said base passage;

a first conduit extending between said discharge end of said base passage and said port of said receptacle wall, said first conduit having a first conduit wall;

an access port extending through said first conduit wall; and, a cover having a cover wall cooperable with said access port for forming a fluid-tight seal thereacross, wherein said cover comprises an extension having an aperture for accommodating a fastener for selectively securing said cover to said upper housing.

18. The vacuum cleaner according to claim 17 further including a second conduit extending from said first conduit forming a junction therewith, said second conduit having a second conduit wall.

19. The vacuum cleaner according to claim 18, wherein said access port is adjacent said junction of said first and said second conduits.

20. The vacuum cleaner according to claim 19, wherein said access port is positioned along said first conduit at said junction of said first conduit and said second conduit.

21. The vacuum cleaner according to claim 19, wherein said access port includes a port peripheral wall extending from at least one of said first conduit wall and said second conduit wall and defining the periphery of said access port.

22. The vacuum cleaner according to claim 21, wherein said cover includes a port engaging portion cooperable with said port peripheral wall of said access port to form a fluid-tight seal therewith, and said cover wall extending along said port engaging portion of said cover adjacent said port peripheral wall.

23. The vacuum cleaner according to claim 22, wherein said cover includes a handle extending opposite said port engaging portion.

24. The vacuum cleaner according to claim 18, wherein said second conduit has a proximal end adjacent said junction with said first conduit, a distal end opposite said proximal end, and a coupling supported adjacent said distal end.

25. The vacuum cleaner according to claim 17 wherein said cover further comprises a fastener base for accommodating a shaft of a fastener.

26. The vacuum cleaner according to claim 17, wherein said first conduit wall includes a first rigid wall portion defining a first conduit passage, and said upper housing further includes a second rigid wall portion defining a second conduit passage extending from said first conduit passage and forming a junction therewith, said second conduit passage being in fluid communication with said first conduit passage at said junction.

27. The vacuum cleaner according to claim 26, wherein said access port extends through said first rigid wall portion adjacent said junction between said first and second conduit passages.

28. The vacuum cleaner according to claim 26, wherein said upper housing includes a valve disposed along at least one of said first conduit passage and said second conduit passage, said valve being moveable between a first and a second end position.

29. The vacuum cleaner according to claim 28, wherein in said first end position, said valve permits a flow of air through said first conduit and substantially prevents a flow of air through said second conduit.

30. The vacuum cleaner of claim 29 wherein in said second end position, said valve permits a flow of air through said second conduit and substantially prevents a flow of air through said first conduit.

31. A vacuum cleaner comprising:

a nozzle base having at least one base wall defining a base passage, said base passage having an intake end adjacent a subjacent surface and a discharge end opposite said intake end;

an upper housing mounted on said nozzle base, said upper housing having a body portion including a filter chamber, wherein said filter chamber includes at least one receptacle wall, said at least one receptacle wall having a port in communication with said filter chamber;

a vacuum source supported on one of said nozzle base and said upper housing and in fluid communication with said base passage, said vacuum source generating suction airflow at said intake end of said base passage;

a conduit extending between said discharge end of said base passage and said port of said filter chamber, said conduit having a conduit wall;

an access port extending through said conduit wall; and, a transparent cover having a cover wall cooperable with said access port forming a fluid-tight seal thereacross, said transparent cover allowing an operator to see any blockages in said conduit.

32. The vacuum cleaner according to claim 31, wherein said cover is at least partially S-shaped.

33. The vacuum cleaner according to claim 31, wherein said cover has a first end and a second end.

34. The vacuum cleaner according to claim 33 further comprising a flexible hose extending from said discharge opening and mounted to said cover.

35. The vacuum cleaner according to claim 34, wherein said second end of said cover includes a cylindrical recess for engaging said flexible hose.

36. The vacuum cleaner according to claim 35, wherein said cylindrical recess is threaded.

37. The vacuum cleaner according to claim 31, wherein said cover has at least one flange with an aperture for accommodating a fastener for securing said cover to said upper housing.

38. The vacuum cleaner according to claim 31 further including a gasket interposed between said cover and said upper housing.

39. The vacuum cleaner according to claim 38, wherein said cover includes a gasket groove extending peripherally along at least a portion of said cover, and said gasket is at least partially received in said gasket groove.

40. The vacuum cleaner according to claim 31, wherein said conduit wall includes a first rigid wall portion defining a first conduit passage, and said upper housing further includes a second rigid wall portion defining a second conduit passage extending from said first conduit passage and forming a junction therewith, said second conduit passage being in fluid communication with said first conduit passage at said junction.

41. The vacuum cleaner according to claim 40, wherein said access port extends through said first rigid wall portion adjacent said junction between said first and second conduit passages.

42. The vacuum cleaner according to claim 40, wherein said upper housing includes a valve disposed along at least one of said first conduit passage and said second conduit passage, said valve being moveable between a first and a second end position.

43. The vacuum cleaner according to claim 42, wherein in said first end position, said valve permits a flow of air through said first conduit and substantially prevents a flow of air through said second conduit.

44. The vacuum cleaner of claim 43 wherein in said second end position, said valve permits a flow of air through said second conduit and substantially prevents a flow of air through said first conduit.

* * * * *